US005193308A

United States Patent [19]

Davidian

[11] Patent Number: 5,193,308

[45] Date of Patent: Mar. 16, 1993

[54] SNAP-IN HINGE FOR DOORS WITH HOLLOW METAL FRAMES

[75] Inventor: Richard M. Davidian, Kensington, Conn.

[73] Assignee: The Stanley Works, New Britain, Conn.

[21] Appl. No.: 918,587

[22] Filed: Jul. 22, 1992

[51] Int. Cl.[5] ..... E05D 15/01; E05D 7/10

[52] U.S. Cl. ..... 49/381; 16/257; 16/258; 49/399

[58] Field of Search ..... 49/400, 381, 398, 399; 16/257, 258

[56] References Cited

U.S. PATENT DOCUMENTS

| | | | |
|---|---|---|---|
| 1,536,490 | 5/1925 | Geschickter | 16/257 |
| 2,474,311 | 6/1949 | Graham . | |
| 2,876,874 | 3/1959 | Benham | 49/381 |
| 3,172,147 | 3/1965 | Robinson et al. . | |
| 3,216,053 | 11/1965 | Felix | 49/399 X |
| 3,284,844 | 11/1966 | Seckerson . | |
| 3,423,786 | 1/1969 | Arias, Jr. et al. . | |
| 3,685,852 | 8/1972 | Wendorf et al. . | |
| 3,728,758 | 4/1973 | Johansen . | |
| 3,921,253 | 11/1975 | Nelson . | |
| 4,159,548 | 7/1979 | Hewson . | |
| 4,430,771 | 2/1984 | Salice . | |
| 4,517,706 | 5/1985 | Lautensch-Lager et al. . | |
| 4,583,261 | 4/1986 | Rock et al. . | |
| 4,731,903 | 3/1988 | Kennedy et al. . | |
| 4,748,671 | 5/1988 | Wiegel . | |
| 4,817,237 | 4/1989 | Murphy . | |
| 4,863,062 | 9/1989 | Holliday . | |
| 4,937,917 | 7/1990 | Rock et al. . | |
| 4,982,475 | 1/1991 | Killingstad . | |

*Primary Examiner*—Philip C. Kannan

[57] ABSTRACT

A snap-in hinge assembly for mounting doors on door frames comprises a hinge with one of its leaves providing a plurality of spaced recesses, and a hinge leaf receiving receptacle mounted in a recess. The receptacle includes a reinforcing member having mounting portions secured to the frame or door and a seat portion defining a channel of a width dimensioned to receive the length of the hinge leaf. The seat portion has latch receiving recesses therein cooperatively positioned relative to the spaced recesses in the hinge leaf and a plurality of latch elements are disposed in the latch receiving recesses. Biasing elements bias the latch elements outwardly of the latch receiving recesses into the channel and they seat in the hinge leaf recesses when the hinge leaf is inserted thereinto. Thus, the door with one hinge leaf secured thereinto may be mounted on the door frame by inserting and sliding the hinge leaves into the channels of the receptacles to engage the latch elements in their recesses.

25 Claims, 5 Drawing Sheets

SNAP-IN HINGE FOR DOORS WITH HOLLOW METAL FRAMES

BACKGROUND OF THE INVENTION

The present invention relates to hinge assemblies for mounting doors on door frames and, more particularly, to a snap-in hinge construction enabling facile mounting of the door on the door frame.

As is well known, hinges utilized for mounting doors upon door frames conventionally employ a pair of hinge leaves which are usually pivotally connected by a hinge pin or the like passing through a barrel defined by knuckle portions on adjacent portions of the hinge leaves Usually the process of mounting the door upon the door frame requires the assembly of one of the hinge leaves to the door by fasteners, and the assembly of the other hinge leaf to the door frame by fasteners or the like.

In one method of assembly, the hinges are mounted on the door which is then moved adjacent the door frame to locate the jamb leaves of the hinge on the frame, and the hinges are then fastened to the frame. This operation involves substantial manipulation and stabilization of the door during the assembly which is cumbersome and can be quite heavy In a variation, the assembled hinge may be first assembled on the door frame and the door positioned in the frame to fasten the hinges thereto. This is equally difficult.

In another method, the hinge placement is carefully measured and the leaves separately mounted on the door and frame. The door is then moved to the frame and the hinge knuckles interfitted and the hinge pins inserted. This also involves substantial manipulation.

It is an object of the present invention to provide a novel snap-in hinge assembly for rapidly mounting doors on door frames.

It is also an object to provide such a snap-in hinge assembly which provides secure mounting of the door on the frame and enables use of conventional heavy duty hinge construction.

Another object is to provide such a snap-in hinge assembly which may be fabricated relatively easily and economically from conventional hinges, and components which produce a simple and rugged receptacle which may be readily assembled to the door frame.

A further object is to provide such a snap-in hinge assembly in which the receptacle may be readily modified to seat hinges with leaves of different length.

SUMMARY OF THE INVENTION

It has now been found that the foregoing and related objects may be readily attained in a snap-in hinge assembly for mounting doors on door frames in which the hinge comprises a pair of leaves and pivot means coupling the leaves for pivotal movement. One hinge leaf has fastening means to secure it to the door or frame and the other hinge leaf has a plurality of spaced recesses therein. The assembly also includes a hinge leaf receiving receptacle adapted to be mounted in a recess in the other of the door and door frame, and comprising a reinforcing member having mounting portions adapted to be secured thereto and a seat portion defining a channel of a width dimensioned to receive the length of the other hinge leaf. The seat portion has latch receiving recesses therein cooperatively positioned relative to the spaced recesses in the other hinge leaf, and a plurality of latch elements are disposed in the latch receiving recesses. Biasing means biases the latch elements outwardly of the latch receiving recesses into the channel, and the latch elements seat in the hinge leaf recesses when the other hinge leaf is inserted into the channel. Thus, with one leaf of the hinges mounted on the door or frame, the door may be mounted on the door frame by inserting the other leaves of the hinges into the recess and sliding them into the channel of the receptacle to engage the latch elements in the recesses.

Preferably, a shoe member has a bridge portion extending substantially parallel to the seat portion and cooperating therewith to define the channel therebetween. The shoe member desirably has end walls spacing the bridge portion from the seat portion, and its end walls have tongues thereon seating in recesses in the seat portion. Desirably, the seat portion has a multiplicity of pairs of recesses of different axial spacing adapted to seat tongues formed on the end walls of shoe members of different lengths, thereby permitting variation in the width of the channel to snugly seat hinge leaves of different length.

Generally, the mounting portions of the reinforcing member extend from the ends of the seat portion, and the reinforcing member is formed of sheet metal with a generally U-shaped seat portion.

Preferably, the latch receiving recesses of the seat portion in which the latch elements are seated comprise apertures extending through the seat portion and the latch elements have a head portion extending through the apertures into the channel, and a base portion disposed on the opposite surface of the seat portion. The biasing means is disposed on the other surface of the seat portion and bears upon the base portion of the latch elements, and conveniently comprises a leaf spring secured to the seat portion.

In the preferred embodiment, the latch receiving apertures in the seat portion are horizontally elongated and the head portions are of cooperating elongated cross section to prevent relative rotation. The head portions of the latch elements have a cam surface on their ends to allow the hinge leaf to cam them outwardly of the channel during its insertion.

In the more common door assembly, the door frame has a front face and a side face and providing a recess defined in part thereby. The front face of the door frame has vertically extending slots therein to provide entry into the recess therebehind, and the door is cooperatively dimensioned with respect to the frame. A plurality of the hinge leaf receiving receptacles are mounted in the recess of the door frame in alignment with the slots, and the mounting portions of the reinforcing members are secured to the inner surface of the side face of the frame.

Alternatively, or in addition, the door may have a recess and slots in its face. Receptacles may be mounted in the recess and secured to the skin or frame of the door, and hinge leaves may be inserted into these receptacles, either before or after the other hinge leaves have been mounted on the door frame.

DETAILED DESCRIPTION OF THE ILLUSTRATED EMBODIMENTS

Figure 1:
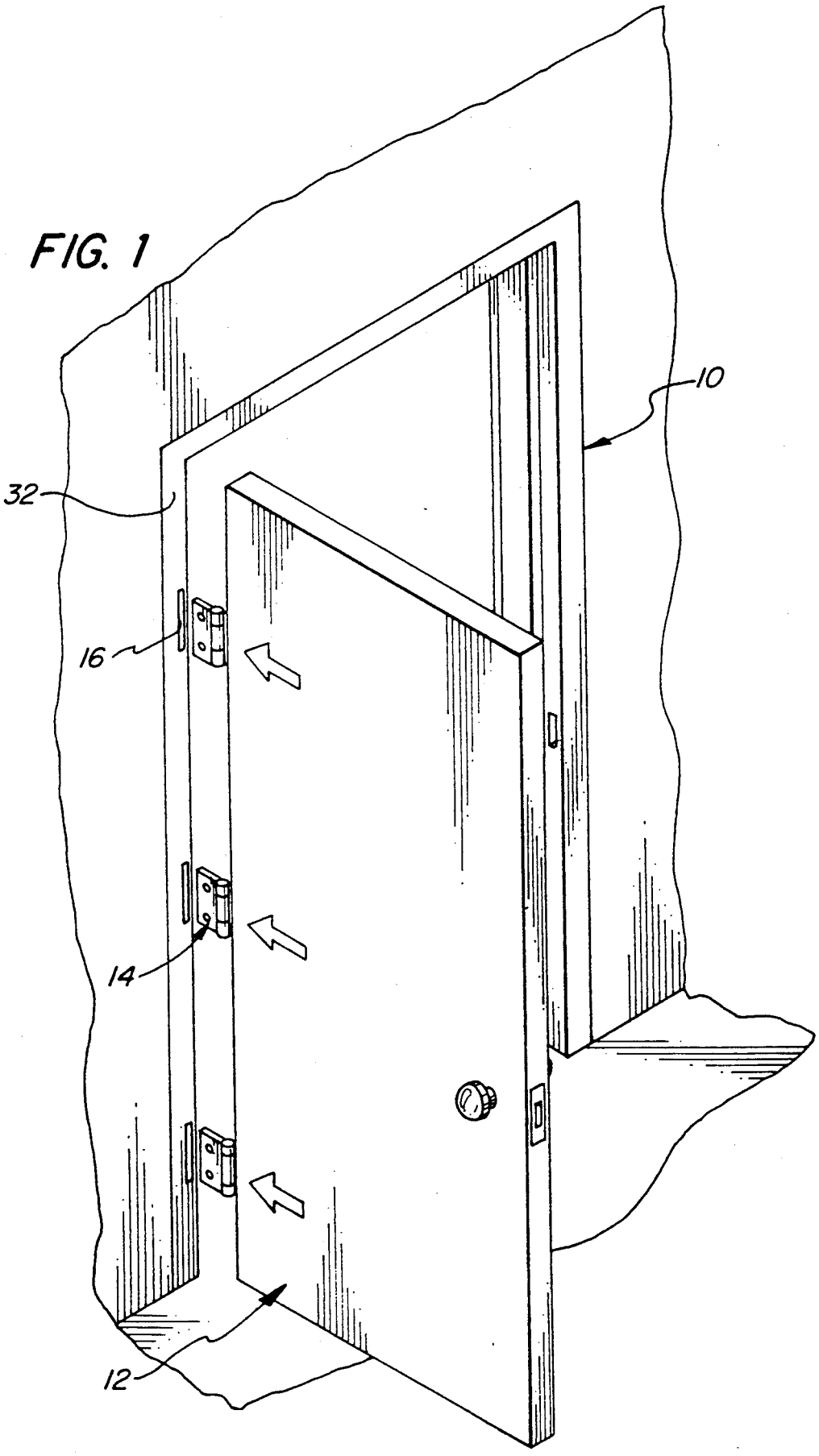
FIG. 1 is a fragmentary perspective view of a door installation embodying the hinge assembly of the present invention, but with the door separated from the frame prior to assembly therewith.

Turning first to FIG. 1, therein illustrated is a door installation embodying the present invention in which a door frame generally designated by the numeral 10 is to have mounted thereon a door generally indicated by the numeral 12 by means of the hinges generally designated by the numeral 14. Also seen in this view in which the hinge leaves have not been inserted into the mounting assembly within the door frame 10 are the slots 16 in the front face 32 of the door frame 10 through which the hinge leaves are inserted.

Figure 2:
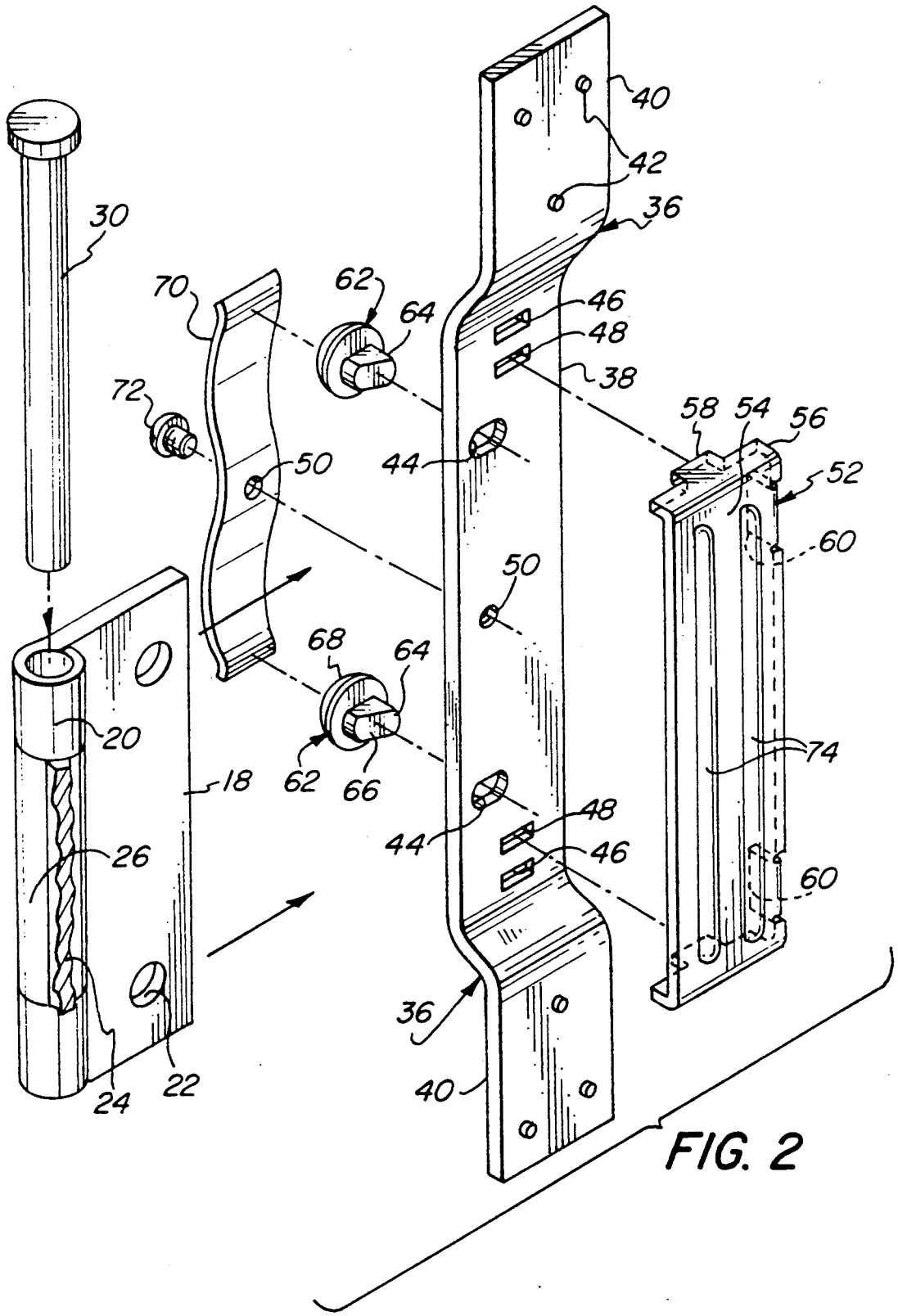
FIG. 2 is a exploded view of the hinge assembly of the present invention drawn to an enlarged scale from that seen in FIG. 1, and with the door hinge leaf broken away.
Figure 3:
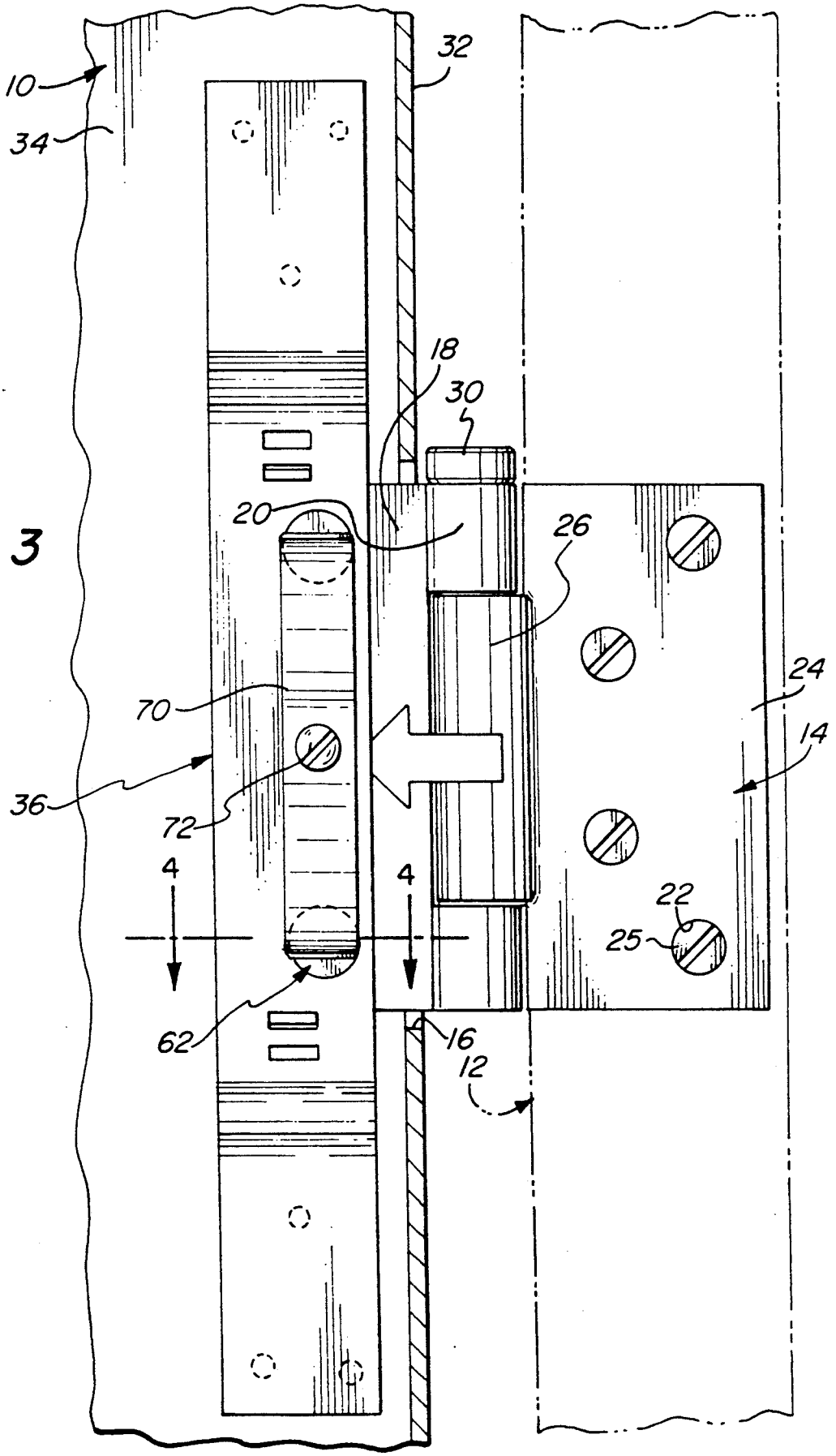
FIG. 3 is a fragmentary side elevational view of the door installation with the door mounted on the frame and illustrated in phantom line, with the arrow to indicate the direction of insertion of the hinge into the receptacle within the door frame.

Turning now to FIGS. 2 and 3, the hinges 14 employ a conventional two leaf construction with the leaf 24 being mounted upon the door 12 by fasteners 25 extending through the mounting apertures 28 into the door 12. The leaf 24 has a single central knuckle 26 in this illustrated 3-knuckle embodiment; however, other knuckle arrangements may be utilized.

The leaf 18 which is to be mounted in the door frame 10 has a spaced pair of mounting apertures 22 and a pair of knuckles 20 which cooperate with the knuckle 26 to provide the barrel which receives the hinge pin 30.

The receptacle within the door frame 10 is generally comprised of the reinforcing member generally designated by the numeral 36, the shoe member generally designated by the numeral 52, the spring actuated latch elements generally designated by the numeral 62 and the spring 70.

As illustrated, the reinforcing member 36 has a central seat portion 38 of generally U-shaped configuration and a pair of mounting portions 40 extending from the opposite ends thereof. A multiplicity of studs 42 are provided on the mounting portions 40 for facilitating welding to the side face 34 of the door frame 10. The seat portion 38 has a pair of horizontally elongated apertures 44 to receive the latch elements 62, two pairs 46, 48 of horizontally elongated apertures adjacent its ends, and a centrally disposed fastening aperture 50.

The shoe member 52 has a bridge portion 54 with end walls 56 extending perpendicularly thereto and provided with tongues 58 which seat in the pair of apertures 48 to locate the shoe member 32. As will be appreciated, the end walls 56 space the bridge portion 54 from the opposed surface of the seat portion 38 and cooperated therewith to define a channel therebetween into which the hinge leaf 18 is inserted. The shoe member 52 also has legs 60 along one side edge of the bridge portion 54 which further define the limits of the channel into which the hinge leaf 18 may be inserted and also serve to stabilize and space the bridge portion 54. To provide enhanced rigidity and to position its channel defining surface to the bridge portion 54 relative to the edge of the slot 16, a pair of ribs 74 are formed on its surface which abuts the side face 34 of the frame 10.

The latch elements 62 have head portions 64 of elongated cross section cooperating with the configuration of the apertures 44 in which they are seated, and the outer or free end thereof is provided with a cam surface 66 sloping upwardly in the direction of insertion of the hinge leaf 18 thereinto so as to facilitate a camming of the latch elements 62 outwardly of the channel upon insertion of the hinge leaf 18. The latch elements 62 also have an enlarged base portion 68 which bears against the opposite surface of the seat portion 38 of the reinforcing member 36.

In this embodiment, the biasing action upon the latch elements 62 is provided by a single leaf spring 70 which is secured to the seat portion 38 of the reinforcing member 36 by the fastener 72 which mechanically engages in the aperture 50 therein.

As seen in FIG. 3, the mounting assembly is preassembled and welded to the inside surface of the side face 34 of the door frame 10 in alignment with the cutout or slot 16 in the front face 32 which is spaced a small distance from the juncture of the two faces 32, 34. The reinforcing member 36 is dimensioned and configured to space the seat portion 38 from the side face 34 and in alignment with the far side of the cutout or slot 16. Similarly, the ribs 74 space the bridge portion 54 of the shoe member 52 from the side face 34 to align its surface with the near side of the slot or cutout 16, thereby defining between these two elements the channel to receive the hinge leaf 18.

Figure 4:
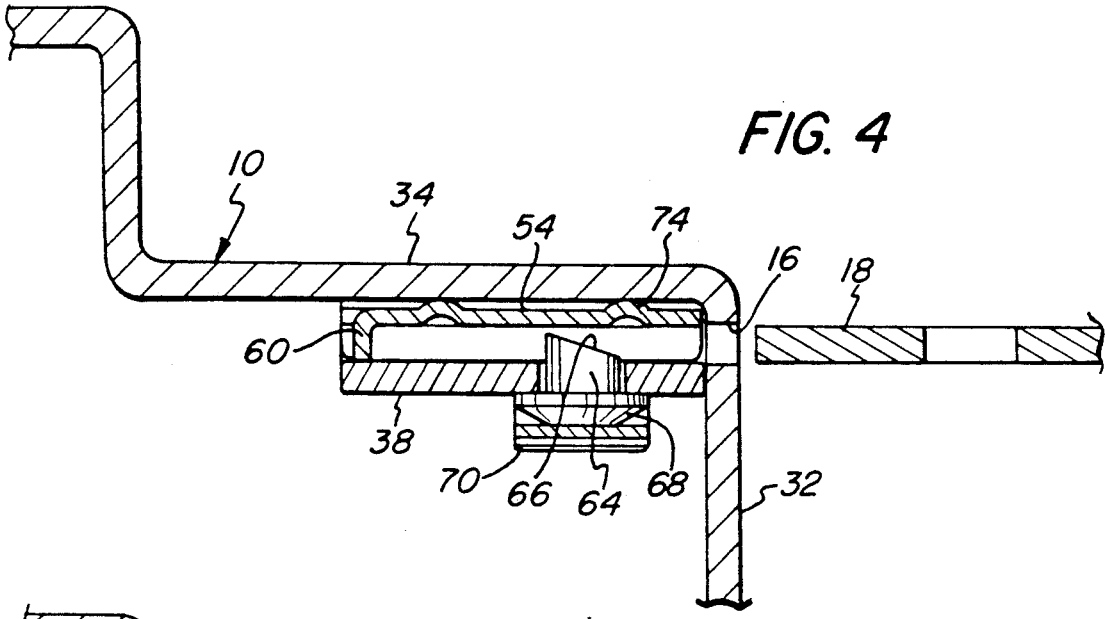
FIGS. 4, 5, and 6 are fragmentary sectional views along the line 4—4 of FIG. 3 showing the hinge and door at various points in the insertion movement into the receptacle within the fragmentarily illustrated door frame.
Figure 5:
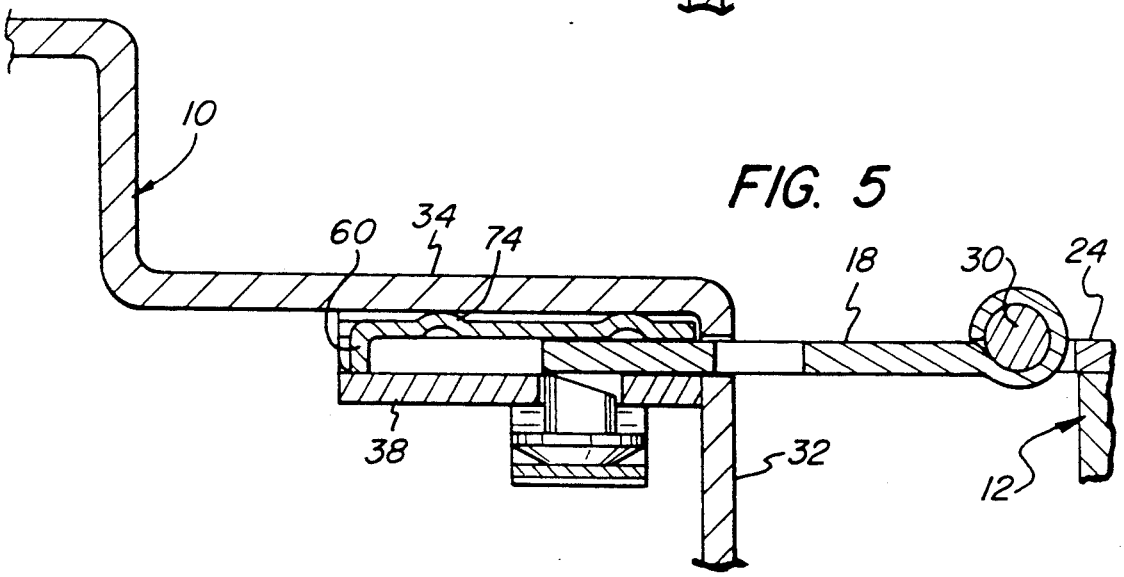

To effect assembly of the door 12 on the door frame 10, the hinge leaves 24 are first mounted upon the door 12 and the hinges 14 are fully assembled. The door 12 is then moved into a position adjacent the front face 32 of the door frame 10 with the hinge leaves 18 in alignment with the slots 16 as shown in FIG. 4. The door 12 and hinge leaves 18 are then moved in the direction of the door frame 10 with the hinge leaves 18 being moved through the slots 16 and into the channels defined by the receptacles. As the hinge leaves 18 reach the latch elements 62, they bear upon the cam surface 66 and cause the latch elements 62 to be biased outwardly against the action of the spring 70 as seen in FIG. 5. After the insertion motion of the door 12 has been completed and the door hinge leaf 18 abuts the side legs 60 of the shoe member 52, the mounting apertures 22 in the jamb leaves 18 are aligned with the latch elements 62 and the springs 70 bias the head portions 64 of the latch elements 62 into the mounting apertures 28 to firmly secure the door 12 upon the door frame 10.

Figure 6:
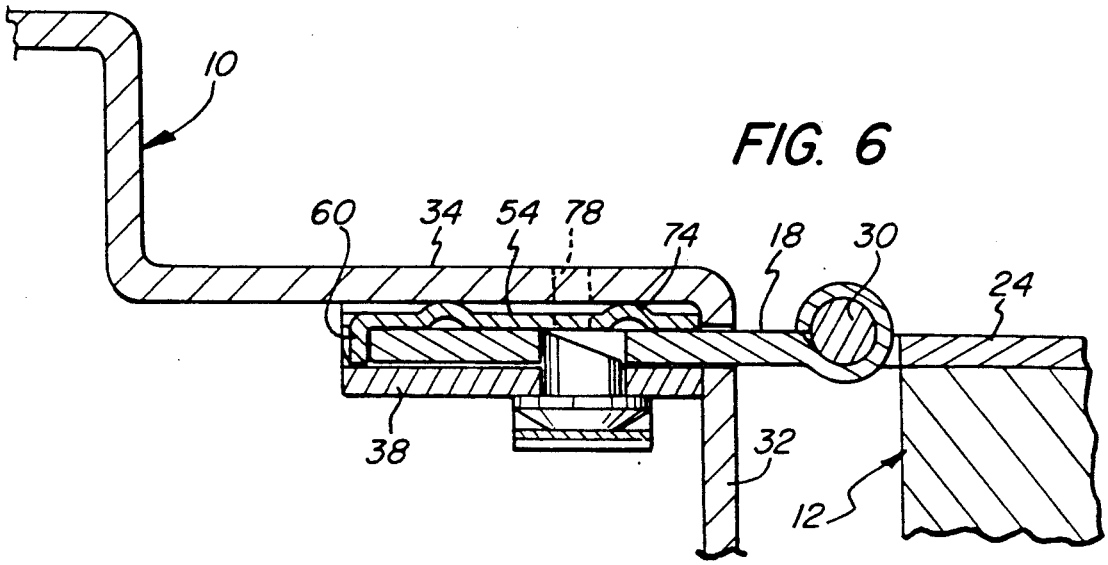
Figure 7:
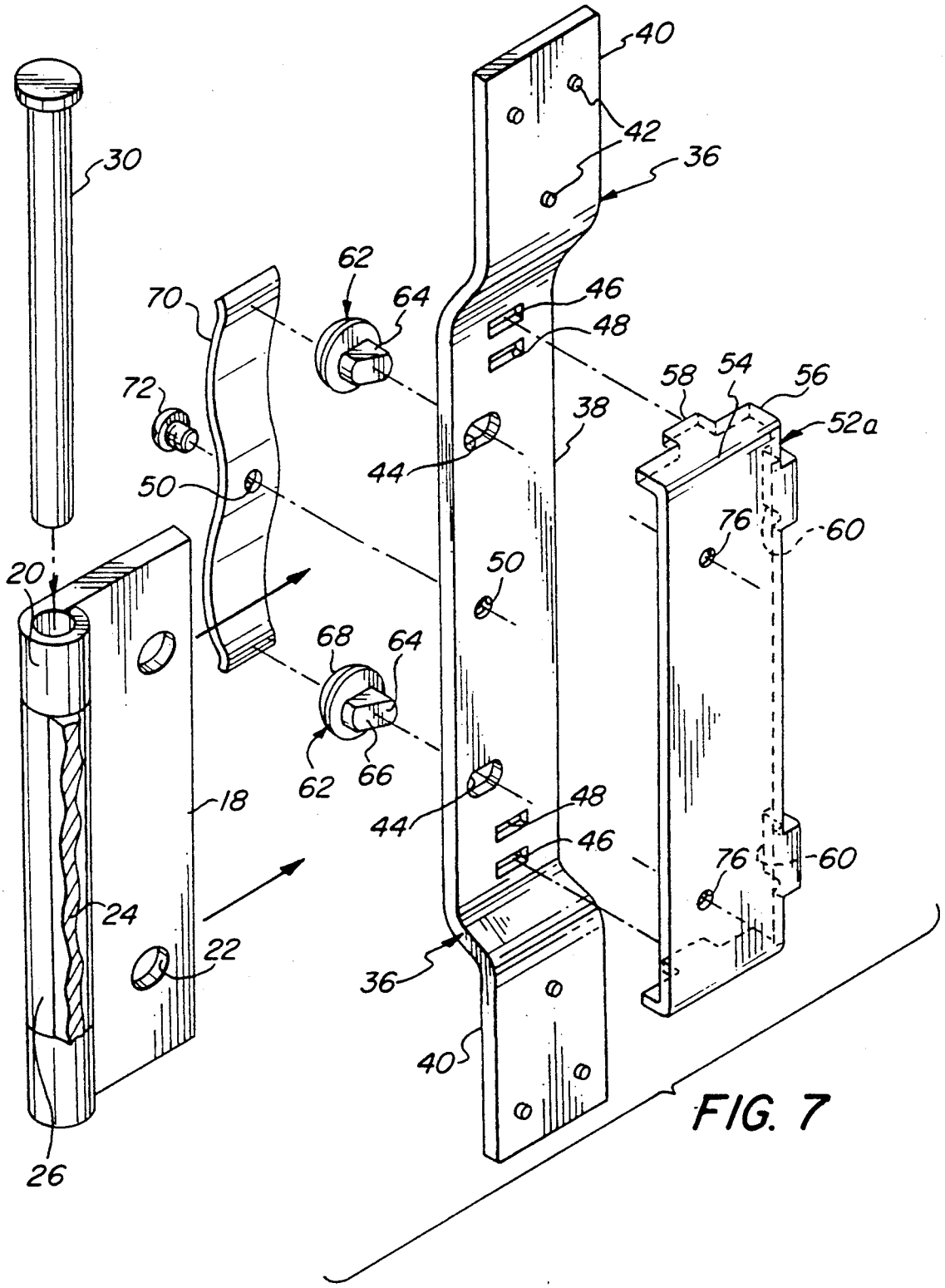
FIG. 7 is an exploded view of the hinge assembly utilizing another embodiment of shoe.

In the embodiment of FIG. 7, the shoe 52*a* is of a thickness to provide the desired spacing from the side face 34 of the door frame 10 so that the spacing and reinforcing ribs 74 of the previous embodiment are not required. In addition, the shoe 52*a* is provided with a pair of access apertures 76 corresponding to the position of the latch elements 62. With such apertures 76, the side face 34 of the door frame 10 may be provided with access apertures as indicated by the dotted lines 78 in FIG. 6, or knockouts or markings (not shown), aligned with the access apertures 76. In this fashion, an access aperture in the side face 34 of the frame 10 will enable insertion of a tool therethrough and through the access aperture 76 to press against the heads 64 of the latch elements 62. In this manner, the latch elements 62 may be pushed against the biasing spring 70 to dispose them from the apertures 22 of the hinge leaf 18 and allow the hinge leaf to be withdrawn from the receptacle.

As will be readily appreciated, the snap-in hinge assembly of the present invention may be utilized with various types of doors including conventional wood doors, doors with metal skins, and doors with fiberglass or other synthetic resin skins. However, the door frame with which the assembly is utilized must be one in which the receptacle may be readily mounted in a recess formed therewithin and which permits the formation of the slots in the front face of the door frame through which the hinge leaves are inserted. Conveniently, the frame is of conventional metal construction to provide these considerations.

When doors with reinforced metal skins are employed, the snap-in hinge assembly of the present invention may also be applied to permit insertion of the leaves into receptacles mounted inside a recess within the door on the reinforcing elements or on the skin if sufficiently rigid. By providing the receptacles of the present invention in both the door and the door frame, the door can be positioned In the door frame and both hinge leaves simultaneously inserted into the receptacles through slots in the outer faces of the door and door frame. However, this use of the receptacles in the door also allows mounting of the door by aligning its slots with hinges previously mounted on the door frame and moving the door towards the door frame to seat the leaves in the door receptacles. The door mounting of the hinge assembly will preferably be with the hinge leaves extending through slots in the outer face of the door into receptacles mounted on the side edge of the door. As still another option, the leaves of the hinges may be premounted to the door using the receptacles of the present assembly and then assembled to the door frame in the manner illustrated in the drawing.

The hinges which comprise a portion of the assembly can be of any pivot type providing jamb leaves to be inserted into the receptacles. Most usually, these will comprise butt hinges having 2–6 knuckles defining a barrel into which a hinge pin is inserted. However, other types of hinges providing the desired pivot and a leaf for insertion into the receptacle may also be employed.

In the illustrated embodiment, a leaf spring has been shown as secured to the seat portion of the reinforcing member by a threaded fastener. The leaf spring may also be riveted or welded to the reinforcing portion. Instead of a leaf spring, separate springs may be utilized such as a coil spring disposed between the base portion of the latching elements and the surface of the reinforcing member.

In the preferred method of assembly of the receptacle to the door frame, the end portions on the reinforcing member are welded to the inside surface of a metal door frame. However, other methods for mounting the receptacle may be employed such as fasteners extending through the door frame or seated in suitable formations on the inside surface of the door frame although the latter would require specially fabricated door frames. One of the advantages to the present invention is that it may be readily adapted to existing conventional metal door frames. A similar procedure may also be used to mount the receptacles to a door.

As indicated with respect to the embodiment of FIG. 7, there may be occasions on which it is desired to remove the hinge leaves from the receptacles. However, the door may be removed from the jamb leaves by removing the hinge pins for normal maintenance activities. Should it be desirable to remove the hinge leaves from the receptacles, the door frame or the door may be provided with small apertures for insertion of a tool therethrough to press the latching elements outwardly of the hinge leaf. Alternatively, knockouts may be positioned appropriately in the face of the door frame or door so that they may be punched out if necessary.

Still another alternative is to merely provide some form of marking on the outer surface of the side face of the frame or in the face of the door to indicate the positions where the latch elements are located and small holes can be drilled into the face of the frame or door to enable the insertion of a relatively small diameter tool to effect the release of the latch elements from the hinge leaf.

Generally, it has been found that two latch elements of the type illustrated in the attached drawings will be sufficient for securely mounting the jamb leaves in the receptacles since the leaves are trapped within the receptacle and only shear forces are placed thereon. However, if so desired, more latch elements may be provided. Although a single latch element would be effective to resist the outward movement in combination with the walls defining the channel, generally two latch elements are preferred.

It should also be appreciated that it is desirable to provide the legs along the inner edge of the shoe member to positively position the hinge leaf which is being inserted therein and prevent overtravel beyond alignment with the latch elements. Thus, these legs define the maximum travel and desirably position the apertures in the hinge leaf to correspond with the location of the latch elements to ensure proper alignment during the insertion motion.

Thus, it can be seen from the foregoing detailed description and attached drawings that the snap-in hinge assembly of the present invention enables rapid mounting of doors on door frames with much less difficulty. The receptacles within the door frame or door securely mount the jamb leaves to provide a firm support for the door on the door frame, and they may be relatively and economically fabricated and easily assembled to the inside surface of the door frame or door. The hinge assemblies of the present invention may utilize conventional hinges with or without modification to reflect the desired number of latch elements, and thus permit a wide variation in the appearance of the hinges utilized in connection therewith.

Having thus described the invention, what is claimed is:

1. A snap-in hinge assembly for mounting doors on door frames comprising:

(a) a hinge comprising a pair of leaves and pivot means coupling said leaves for pivotal movement, said leaves having recesses therein for fastening means to secure said leaves to an associated door and the door frame;

(b) a hinge leaf receiving receptacle adapted to be mounted in a recess and including:

(i) a reinforcing member having mounting portions adapted to be secured to the frame defining a recess and a seat portion defining a channel of a width dimensioned to receive the length of one of said hinge leaves, said seat portion having latch receiving recesses therein cooperatively positioned relative to said spaced recesses in said one hinge leaf;

(ii) a plurality of latch elements disposed in said latch receiving recesses; and (iii) biasing means biasing said latch elements outwardly of said latch receiving recesses into said channel, said latch elements seating in said one hinge leaf recesses when said one hinge leaf is inserted into said channel, whereby the associated door may be mounted on the associated door frame by inserting said one hinge leaf into the receptacle and sliding said one hinge leaf into said channel of said receptacle to engage said latch elements in said recesses of said one hinge leaf.

2. The snap-in hinge assembly in accordance with claim 1 wherein the other of said hinge leaves has apertures extending therethrough and fasteners to secure said other of said hinge leaves to the associated door and said receptacle is adapted to be mounted on the inside surface of the side face of the associated door frame.

3. The snap-in hinge assembly in accordance with claim 1 wherein said receptacle additionally includes a shoe member having a bridge portion extending substantially parallel to said seat portion and cooperating therewith to define said channel therebetween.

4. The snap-in hinge assembly in accordance with claim 3 wherein said shoe member has apertures therein aligned with said latch elements and through which a tool may be inserted to move said latch elements outwardly of the recesses in said one hinge leaf.

5. The snap-in hinge assembly in accordance with claim 3 wherein said shoe member has end walls spacing said bridge portion from said seat portion.

6. The snap-in hinge assembly in accordance with claim 5 wherein said end walls of said shoe member have tongues thereon seating in recesses in said seat portion.

7. The snap-in hinge assembly in accordance with claim 6 wherein said seat portion has a multiplicity of pairs of recesses of different axial spacing adapted to seat tongues formed on the end walls of shoe members of different lengths, thereby permitting variation in the width of the channel to snugly seat hinge leaves of different length.

8. The snap-in hinge assembly in accordance with claim 1 wherein said mounting portions of said reinforcing member extend from the ends of said seat portion.

9. The snap-in hinge assembly in accordance with claim 8 wherein said reinforcing member is formed of sheet metal with a generally U-shaped seat portion and said mounting portions extend from the ends thereof.

10. The snap-in hinge assembly in accordance with claim 1 wherein said latch receiving recesses of said seat portion in which said latch elements are seated comprise apertures extending through said seat portion and said latch elements have a head portion extending through said apertures into said channel and a base portion disposed on the opposite surface of said seat portion.

11. The snap-in hinge assembly in accordance with claim 10 wherein said biasing means is disposed on said other surface of said seat portion and bears upon said base portion of said latch elements.

12. The snap-in hinge assembly in accordance with claim 11 wherein said biasing means comprises a leaf spring secured to said seat portion.

13. The snap-in hinge assembly in accordance with claim 10 wherein said latch receiving apertures in said seat portion are horizontally elongated and said head portions are of cooperating elongated cross section to prevent relative rotation.

14. The snap-in hinge assembly in accordance with claim 13 wherein said head portions of said latch elements have a cam surface on their free ends to allow said other hinge leaf to cam them outwardly of said channel during its insertion.

15. A door assembly employing snap-in hinge assemblies for mounting a door on a door frame comprising:

(a) a door frame member;

(b) a door member cooperatively dimensioned with respect to said door frame member;

(c) a plurality of hinges each comprising a pair of leaves and pivot means coupling said leaves for pivotal movement, at least one of said leaves having a plurality of spaced recesses therein;

(d) a plurality of hinge leaf receiving receptacles mounted in a recess in the other of said door frame and door members, said recess being in alignment with slots in the front face element of said other member defining the face to which said one hinge leaf is to be secured, each of said receptacles including:

(i) a reinforcing member having mounting portions secured to the inner surface of the side face defining element of said other member and a seat portion defining a channel in which is seated said one hinge leaf, said seat portion having latch receiving recesses therein aligned with said spaced recesses in said one hinge leaf;

(ii) a plurality of latch elements disposed in said latch receiving recesses; and (iii) biasing means biasing said latch elements outwardly of said latch receiving recesses into said channel, said latch elements seating in said one hinge leaf recesses, whereby said door member may be mounted on said door frame by inserting said one leaf into said slot and recess of the other of said door frame and door members and sliding said other leaf into said channel of said receptacle to engage said latch elements in said recesses of said other leaf.

16. The door assembly in accordance with claim 15 wherein said reinforcing member is formed of sheet metal with a generally U-shaped seat portion and wherein said mounting portions extend from its end.

17. The door assembly in accordance with claim 15 wherein said door frame member has a front face and a side face and provides a recess defined in part by said faces, said front face of said door frame having a multiplicity of vertically extending slots therein, wherein said other leaves of said hinges are secured to said door by fasteners, wherein said hinge leaf receiving receptacles are mounted in said recess in said door frame and on the inside surface of said side face in alignment with said slots in said front face, whereby said door is mounted on said door frame member by moving said one hinge leaves thereon through said slots in said front face of said door frame member and into said receptacles.

18. The door assembly in accordance with claim 15 wherein said receptacle additionally includes a shoe member having a bridge portion extending substantially parallel to said seat portion and cooperating therewith to define said channel therebetween.

19. The door assembly in accordance with claim 18 wherein said shoe member has apertures therein aligned with said latch elements and through which a tool may be inserted to move said latch elements outwardly of the recesses in said other hinge leaf.

20. The door assembly in accordance with claim 19 wherein said side face of said other member includes means in alignment with said apertures in said shoe member to enable insertion of a tool therethrough to effect such movement of said latch elements.

21. The door assembly in accordance with claim 18 wherein said shoe member has end walls spacing said bridge portion from said seat portion.

22. The door assembly in accordance with claim 21 wherein said end walls of said shoe member have tongues thereon seating in recesses in said seat portion, and wherein said seat portion has a multiplicity of pairs of recesses of different axial spacing adapted to seat tongues formed on the end walls of shoe members of different lengths, thereby permitting variation in the width of said channel to snugly seat hinge leaves of different length.

23. The door assembly in accordance with claim 15 wherein said recesses of said seat portion in which said latch elements are seated comprise apertures extending through said seat portion and said latch elements have a head portion extending through said apertures into said channel and a base portion disposed on the opposite surface of said seat portion.

24. The door assembly in accordance with claim 23 wherein said biasing means is disposed on said other surface of said seat portion and bears upon said base portion of said latch elements.

25. The door assembly in accordance with claim 23 wherein said apertures in said seat portion are horizontally elongated and said head portions are of cooperating elongated cross section to prevent relative rotation, and wherein said head portions of said latch elements have a cam surface on their free ends to allow said other hinge leaf to cam them outwardly of said channel during its insertion.

* * * * *